US007763574B2

(12) United States Patent
Donnelly et al.

(10) Patent No.: US 7,763,574 B2
(45) Date of Patent: Jul. 27, 2010

(54) LUBRICATING COMPOSITIONS CONTAINING SYNTHETIC ESTER BASE OIL, MOLYBDENUM COMPOUNDS AND THIADIAZOLE-BASED COMPOUNDS

(75) Inventors: Steven G. Donnelly, Bethel, CT (US); Ronald J. Hiza, Monroe, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 1267 days.

(21) Appl. No.: 10/961,448

(22) Filed: Oct. 8, 2004

(65) Prior Publication Data

US 2006/0035791 A1 Feb. 16, 2006

Related U.S. Application Data

(60) Provisional application No. 60/510,513, filed on Oct. 10, 2003, provisional application No. 60/519,151, filed on Nov. 12, 2003.

(51) Int. Cl.
*C07D 285/12* (2006.01)

(52) U.S. Cl. ..... 508/274

(58) Field of Classification Search ..... 508/274
See application file for complete search history.

(56) References Cited

U.S. PATENT DOCUMENTS 5,194,621 A 3/1993 Karol et al. ..... 548/142
5,391,756 A * 2/1995 Karol et al. ..... 548/142
5,422,023 A 6/1995 Francisco ..... 252/47
5,707,942 A * 1/1998 Arai et al. ..... 508/365
5,807,813 A 9/1998 Yamada ..... 508/363
5,954,030 A * 9/1999 Sturman et al. ..... 123/446
5,960,753 A * 10/1999 Sturman ..... 123/90.12
6,258,760 B1 7/2001 Ozaki et al. ..... 508/365
6,365,557 B1 * 4/2002 Karol et al. ..... 508/274
6,489,484 B1 12/2002 Karol et al. ..... 548/142
6,541,427 B1 4/2003 Dresel ..... 508/272
6,542,427 B2 4/2003 Dresel ..... 508/272
6,620,771 B2 9/2003 Karol et al.
6,806,241 B2 10/2004 Karol et al. ..... 508/273

* cited by examiner

*Primary Examiner*—Walter D Griffin
*Assistant Examiner*—Frank C Campanell

(57) ABSTRACT

A lubrication composition providing excellent anti-wear protection for corrosion-resistant materials which comprises a major amount of a synthetic ester base oil, and a minor amount of a molybdenum compound and an anti-wear additive selected from the group consisting of 1,3,4-thiadiazole derivative as an anti-wear additive, the reaction products of 2,5-dimercapto-1,3,4-thiadiazole dimers and poly(ether)glycols, and 2,5-dimercapto-1,3,4-thiadiazole monomer and mixtures thereof. Also described is a method for imparting anti-wear properties to a corrosion resistant material, comprising using the lubricating composition of the invention.

23 Claims, 7 Drawing Sheets

LUBRICATING COMPOSITIONS CONTAINING SYNTHETIC ESTER BASE OIL, MOLYBDENUM COMPOUNDS AND THIADIAZOLE-BASED COMPOUNDS

RELATED APPLICATIONS

This application claims priority under 35 U.S.C. §119(e) of U.S. Provisional Application Ser. Nos. 60/510,513, filed Oct. 10, 2003 and 60/519,151, filed Nov. 12, 2003.

BACKGROUND OF THE INVENTION

Current bearing material for gas turbine engines for military use is based on M50 steel. New requirements may be based instead on more corrosion resistant materials manufactured from high chrome alloy steels such as 440C stainless steel and Pyrowear® 675 and Cronidur® 30 as well as hybrid ceramic/metal materials. However, it has been found that the current standard lubricant (tricresyl phosphate (TCP) in a polyolester base) used with M50 steel does not give sufficient wear protection when used with 440C steel.

U.S. Pat. No. 5,422,023 to Francisco teaches an extreme pressure/anticorrosion additive to aviation turbine oils, comprising a 2,5-dimercapto-1,3,4-thiadiazole monomer and an alpha-olefin/maleic ester copolymer. However, in view of advanced corrosion materials now being used in aviation turbines, the requirement for an anticorrosion additive such as the copolymer of Francisco may no longer be necessary. While these thiadiazole monomers are known to impart extreme pressure properties, it has been found (as demonstrated below) that thiadiazole monomer derivatives appear to provide insufficient anti-wear protection when used with corrosion resistant materials such as 440C stainless steel.

U.S. Pat. No. 6,365,557 to Karol teaches additives for imparting extreme pressure properties to lubricating compositions, particularly greases. The additives are the reaction products of 2,5-dimercapto-1,3,4-thiadiazole dimer derivatives with poly(ether)glycols. Such additives would not have been added to lubricating oils because of problems with solubility.

Therefore, an object of the invention is to provide an additive for lubricating compositions, as well as the lubricating oil compositions themselves, which will provide excellent anti-wear performance with respect to corrosion resistant materials.

Another object of the invention is directed toward a method for imparting anti-wear properties to a corrosion resistant material, comprising using the above lubricating compositions described below.

SUMMARY OF THE INVENTION

It has now been found that the objects of the invention can be achieved by an oil composition providing excellent anti-wear protection for corrosion-resistant materials, which comprises a major amount of a synthetic ester lubricating base oils, and a minor amount of a molybdenum compound and an anti-wear additive selected from the group consisting of 1,3,4-thiadiazole derivative as an anti-wear additive, particularly 2,5-dimercapto-1,3,4-thiadiazole dimers (hereinafter "thiadiazole dimers"), the reaction products of such thiadiazole dimers and poly(ether)glycols, and 2,5-dimercapto-1,3,4-thiadiazole monomer, excluding derivatives of such monomer and mixtures thereof. These oil compositions show unexpectedly improved anti-wear properties.

DETAILED DESCRIPTION OF THE INVENTION

Figure 1:
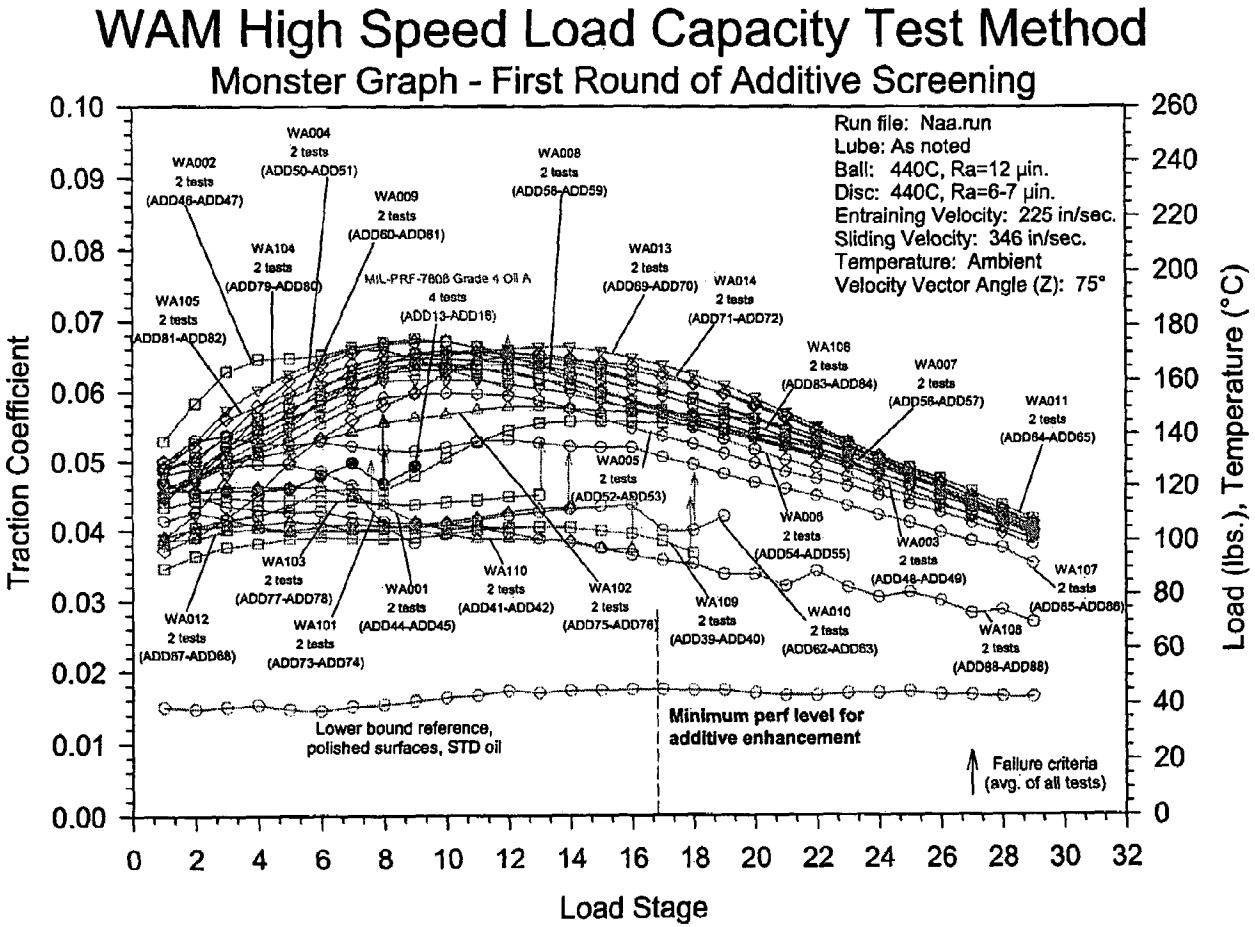
FIG. 1 is a graphical representation of a traction coefficient versus WAM Load Stage plots for fluids formulated with variety of antiwear additives.

The lubricating composition of the invention which provide excellent anti-wear protection are lubricating composition comprising a major amount of a synthetic ester base oil and a minor amount of:

(a) a molybdenum compound selected from the group consisting of molybdenum dithiocarbamate, molybdenum dithiophosphate and a mixture thereof; and (b) one or more anti-wear compound(s) selected from the group consisting of:

(i) a reaction product of:

(A) a thiadiazole dimer having formula (I):

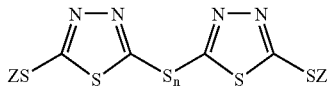

(I)

where Z is hydrogen, or an alkyloxy linkage having formula (II):

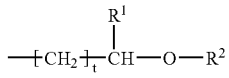

(II)

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, with n being 1 to 2 and t being 0 or 1; and (B) a poly(ether)glycol having formula (III):

(III)

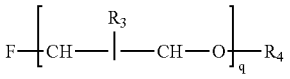

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300;

(ii) a reaction product of:

(A) a thiadiazole dimer having formula (VI):

(VI)

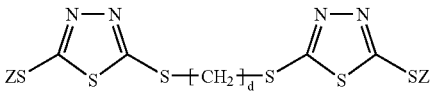

where d is 1 to 5 and Z is hydrogen, an alkyloxy linkage having formula (II):

(II)

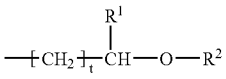

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, wherein t is 0 or 1; and (B) a poly(ether)glycol having formula (III):

(III)

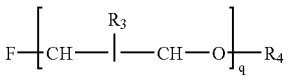

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300; and (iii) a 2,5-dimercapto-1,3,4-thiadiazole monomer which has the structure of formula (VII):

(VII)

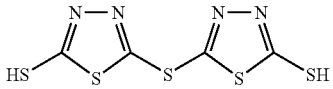

These lubricating compositions are especially useful as gas turbine oils and in providing anti-wear protection for corrosion resistant material. The compositions are particularly effective when used, for example, with 440C stainless steel. The examples given show effectiveness for the inventive additives in a synthetic ester lubricating oil, when used with a corrosion resistant material. With regard to the applicability of using the above additives in other lubricating compositions, it is believed that similar effectiveness could only be extended to greases as problems with solubility may render the use of other base oils unsuitable for combination with the anti-wear additives.

The thiadiazole dimer/poly(ether)glycol reaction products of the invention include those described in U.S. Pat. No. 6,365,557, and preferably prepared according to the method set forth therein, which patent is incorporated herein by reference, as well as U.S. Pat. No. 6,620,771, also incorporated herein by reference. In a first embodiment, an additive is provided comprising:

(a) a molybdenum compound selected from the group consisting of molybdenum dithiocarbamate, molybdenum dithiophosphate or a mixture thereof; and (b) the reaction product of:

(A) a thiadiazole dimer having formula (I):

(I)

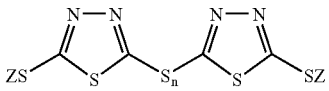

where Z is hydrogen, or an alkyloxy linkage having formula (II):

(II)

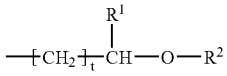

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, with n being 1 to 2 and t being 0 or 1; and (B) a poly(ether)glycol having formula (III):

(III)

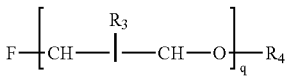

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300.

In a second embodiment, an additive is provided which comprises:

(a) a molybdenum compound selected from the group consisting of molybdenum dithiocarbamate, molybdenum dithiophosphate or a mixture thereof; and (b) monosubstituted and di-substituted thiadiazole condensation adducts from the above thiadiazole dimer/poly(ether) glycol reaction products having formulas (IV) and (V) respectively:

(IV)

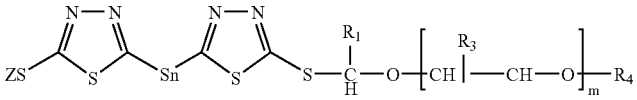

and (V)

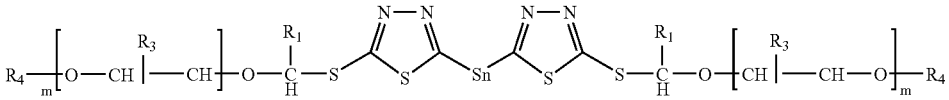

in which $R^1$, $R^3$ and $R^4$ are independently selected from the above-described group of substituents for the reaction products and n is 1 to 2. The number of repeating ether units "m" in the glycol moiety is 1 to 50.

In a third embodiment, an additive is provided which comprises:

(a) a molybdenum compound selected from the group consisting of molybdenum dithiocarbamate, molybdenum dithiophosphate or a mixture thereof; and (b) the reaction product of:

(A) a thiadiazole dimer having formula (VI):

(VI)

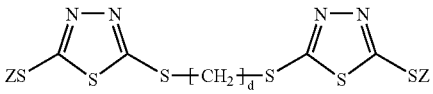

where d is 1 to 5 and Z is hydrogen, an alkyloxy linkage having formula (II):

(II)

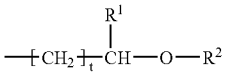

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, wherein t is 0 or 1; and (B) a poly(ether)glycol having formula (III):

(III)

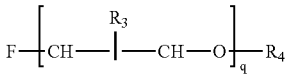

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300.

In a fourth embodiment of the invention, an additive is provided which comprises:

(a) a molybdenum compound selected from the group consisting of molybdenum dithiocarbamate, molybdenum dithiophosphate or a mixture thereof; and (b) a 2,5-dimercapto-1,3,4-thiadiazole monomer which has the structure of formula (VII):

(VII)

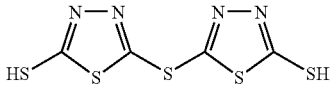

In an alternative embodiment, an additive is provided which comprises:

(a) a molybdenum compound selected from the group consisting of molybdenum dithiocarbamate, molybdenum dithiophosphate or a mixture thereof; and (b) the reaction product of:

(A) a thiadiazole compound being (IA)

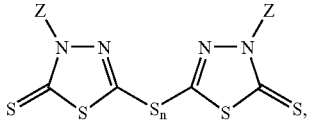

-continued (IB)

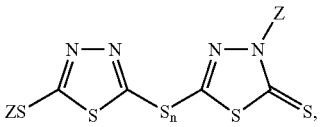

(IC)

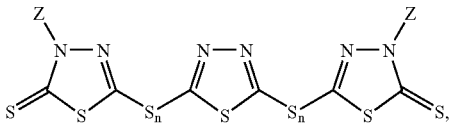

(ID)

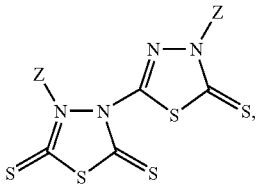

(IE)

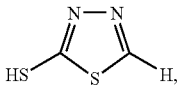

(IF)

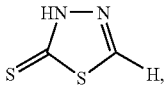

or combinations thereof, where Z is hydrogen, an alkyloxy linkage having the formula (II):

(II)

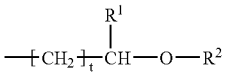

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, where n is 1 to 2 and t is 0 or 1; and (B) a poly(ether)glycol having formula (III):

(III)

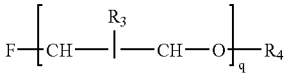

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and where q is 1 to 300.

Particular thiadiazole dimer reaction products, which correspond to the compounds described by (b)(i) above, tested herein include 1,3,4-thiadiazole derivatized by a triethylene glycol monobutyl ether available as Vanlube® 972 additive from R.T. Vanderbilt Company, Inc. (1,3,4-thiadiazole derivative 40% and triethylene glycol monobutyl ether 60%). Vanlube® 972 additive may be prepared according to the method set forth in U.S. Pat. No. 6,365,557, Example 9 as follows: A thiadiazole dimer-glycol reaction product was synthesized by converting 2,5-dimercapto-1,3,4-thiadiazole ("DMTD") in situ to DMTD dimer. Approximately 276.1 grams of DMTD and 367.2 grams of butoxytriethylene glycol were added to a three-neck flask. The flask was attached to a scrubber containing sodium hydroxide to remove hydrogen sulfide during in situ dimer formation. The mixture was bubbled with nitrogen and heated to 120° C. for approximately 5½ hours. After which, the flask was attached to an aspirator and heated for an additional hour. The reaction product was then filtered. The reaction product is believed to be characterized as follows: Z=H, n=1-2, F=OH, $R^3$=H, q=3, $R^4$=butyl.

Also tested herein was 1,3,4-thiadiazole-2(3H)-thione, 5,5-dithiobis, which corresponds to a compound of formula (I) or (IA) wherein Z=H and n=2, which is available as Vanlube® 829 additive from R.T. Vanderbilt Company, Inc. Numerous DMTD monomer derivatives were tested, and these all provided insufficient anti-wear protection. The data in Table 2 provides results for such thiadiazole monomer derivatives, including Cuvan® 826 additive (2,5-bis(n-octyldithio)-1,3,4-thiadiazole 60-80%; dioctyl disulfide 20-40%) and Vanlube® 871 additive (2,5-dimercapto-1,3,4-thiadiazole, alkyl carboxylates). It is also surprising that while DMTD monomer derivatives do not appear to provide good anti-wear protection in these oils, DMTD monomer itself does provide good protection.

Vanchem® DMTD additive, which corresponds to the compound of (iii) or formula (VII) and is available from R.T. Vanderbilt Company, Inc. (2,5-dimercapto-1,3,4-thiadiazole), was tested by itself and with molybdenum dithiophosphate.

In one embodiment of the invention, the molybdenum dithiocarbamate is molybdenum dialkylthiocarbamate (available as Molyvan® 822 additive from R.T. Vanderbilt Company, Inc. as molybdenum dialkylthiocarbamate 50% in petroleum process oil 50%) and the molybdenum dithiophosphate is molybdenum di(2-ethylhexyl)phosphorodithioate (available as Molyvan® L additive from R.T. Vanderbilt Company, Inc).

As an additive concentrate according to the invention, which may be added to a polyol ester lubricating oil or grease to form a lubricating composition of the invention, the weight ratio of the molybdenum compound to the thiadiazole compound may be from about 1:10 to about 10:1. In a more preferred embodiment of the invention, the weight ratio of the molybdenum compound to the thiadiazole compound may be from about 1:4 to about 4:1. In a still further preferred embodiment of the invention, the weight ratio of the molybdenum compound to the thiadiazole compound may be from about 1:2 to about 1:1. In another embodiment of the invention, the amount of molybdenum compound is about 0.5% by weight based on the total weight of the oil composition.

In a lubricating composition comprising the molybdenum and thiadiazole additive, the major amount of synthetic ester base oil or grease is at least about 90% by weight based on the total weight of the lubricating composition. In another embodiment of the invention, the major amount of base oil is at least 95% by weight. In another embodiment of the invention, the major amount of base oil is at least 99% by weight. Preferred synthetic ester base oils are polyolesters.

Another aspect of the invention is directed toward a method for imparting anti-wear properties to a corrosion resistant material, comprising using the above described lubricating compositions.

The lubricating compositions may also contain one or more of the following additives:

1. Antioxidant compounds
2. Seal swell compositions
3. Friction modifiers
4. Extreme pressure/anti-wear agents
5. Viscosity modifiers
6. Phosphates
7. Antifoamants
8. Rust inhibitors
9. Copper corrosion inhibitors 1. Antioxidant Compounds Other antioxidant may be used in the compositions of the present invention, if desired. Typical antioxidants include hindered phenolic antioxidants, secondary aromatic amine antioxidants, sulfurized phenolic antioxidants, oil-soluble copper compounds, phosphorus-containing antioxidants, organic sulfides, disulfides and polysulfides and the like.

Illustrative sterically hindered phenolic antioxidants include orthoalkylated phenolic compounds such as 2,6-di-tertbutylphenol, 4-methyl-2,6-di-tertbutylphenol, 2,4,6-tri-tertbutylphenol, 2-tert-butylphenol, 2,6-disopropylphenol, 2-methyl-6-tertbutylphenol, 2,4-dimethyl-6-tertbutylphenol, 4-(N,N-dimethylaminomethyl)-2,8-di-tertbutylphenol, 4-ethyl-2,6-di-tertbutylphenol, 2-methyl-6-styrylphenol, 2,6-distyryl-4-nonytphenol, and their analogs and homologs. Mixtures of two or more such mononuclear phenolic compounds are also suitable.

Other preferred phenol antioxidants for use in the compositions of this invention are methylene-bridged alkylphenols, and these can be used singly or in combinations with each other, or in combinations with sterically-hindered unbridged phenolic compounds. Illustrative methylene-bridged compounds include 4,4'-methylenebis(6-tert-butyl o-cresol), 4,4'-methylenebis(2-tert-amyl-o-cresol), 2,2'-methytenebis(4-methyl-6-tert-butylphenol), 4,4'-methylenebis(2,6-di-tertbutylphenol), and similar compounds. Particularly preferred are mixtures of methylene-bridged alkylphenols such as are described in U.S. Pat. No. 3,211,652, which is incorporated herein by reference.

Amine antioxidants, especially oil-soluble aromatic secondary amines may also be used in the compositions of this invention. Although aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-.beta.-naphthylamine, phenyl-P-napthylamine, alkyl- or aralkylsubstituted phenyl-.beta.-naphthylamine containing one or two alkyl or aralkyl groups each having up to about 16 carbon atoms, alkyl- or aralkylsubstituted phenyl-p-naphthylamine containing one or two alkyl or aralkyl groups each having up to about 16 carbon atoms, and similar compounds.

A preferred type of aromatic amine antioxidant is an alkylated diphenylamine of the general formula:

$$R_1—C_6H_4—NH—C_6H_4—R_2$$

where $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube® 438L, a material which is understood to be predominately a 4,4'-dinonytdiphenylamine (i.e., bis(4-nonyiphenyl)(amine)) in which the nonyl groups are branched.

Another useful type of antioxidant for preferred inclusion in the compositions of the invention are one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tertbutylphenol, and about 2% of 2,4-di-tertbutylphenol. The reaction is exothermic and thus is preferably kept within the range of about 15.degree. C. to about 70.degree. C., most preferably between about 40.degree. C. to about 60.degree. C.

Another useful type of antioxidant are 2,2,4-trimethyl-1,2-dihydroquinoline (TMDQ) polymers and homologs containing aromatized terminal units such as those described in U.S. Pat. No. 6,235,686, which is hereby incorporated by reference.

Mixtures of different antioxidants may also be used. One suitable mixture is comprised of a combination of: (i) an oil-soluble mixture of at least three different sterically-hindered tertiary butylated monohydric phenols which is in the liquid state at 25.degree. C.; (ii) an oil-soluble mixture of at least three different sterically-hindered tertiary butylated methylene-bridged polyphenols; and (iii) at least one bis(4-alkylphenyl) amine wherein the alkyl group is a branched alkyl group having 8 to 12 carbon atoms, the proportions of (i), (ii) and (iii) on a weight basis failing in the range of 3.5 to 5.0 parts of component (i) and 0.9 to 1.2 parts of component (ii) per part by weight of component (iii), as disclosed in U.S. Pat. No. 5,328,619, which is incorporated herein by reference.

Other useful preferred antioxidants are those included in the disclosure of U.S. Pat. No. 4,031,023, which is herein incorporated by reference.

2. Seal Swell Compositions

Compositions which are designed to keep seals pliable are also well known in the art. A preferred seal swell composition is isodecyl sulfolane. The seal swell agent is preferably incorporated into the composition at about 0.1-3 weight percent. Substituted 3-alkoxysulfolanes are disclosed in U.S. Pat. No. 4,029,587 which is incorporated herein by reference.

3. Friction Modifiers

Friction modifiers are also well known to those skilled in the art. A useful list of friction modifiers are included in U.S. Pat. No. 4,792,410, which is incorporated herein by reference. U.S. Pat. No. 5,110,488 discloses metal salts of fatty acids and especially zinc salts and is incorporated herein by reference. Useful friction modifiers include fatty phosphites, fatty acid amides, fatty epoxides, borated fatty epoxides, fatty amines, glycerol esters, borated glycerol esters alkoxylated fatty amines, borated alkoxylated fatty amines, metal salts of fatty acids, sulfurized olefins, fatty imidazolines, molybdenum dithiocarbamates (e.g., U.S. Pat. No. 4,259,254, incorporated herein by reference), molybdate esters (e.g., U.S. Pat. No. 5,137,647 and U.S. Pat. No. 4,889,647, both incorporated herein by reference), molybdate amine with sulfur donors (e.g., U.S. Pat. No. 4,164,473 incorporated herein by reference), and mixtures thereof.

The preferred friction modifier is a borated fatty epoxide as previously mentioned as being included for its boron content. Friction modifiers are preferably included in the compositions in the amounts of 0.1-10 weight percent and may be a single friction modifier or mixtures of two or more.

Friction modifiers also include metal salts of fatty acids. Preferred cations are zinc, magnesium, calcium, and sodium and any other alkali, or alkaline earth metals may be used. The salts may be overbased by including an excess of cations per equivalent of amine. The excess cations are then treated with carbon dioxide to form the carbonate. The metal salts are prepared by reacting a suitable salt with the acid to form the salt, and where appropriate adding carbon dioxide to the reaction mixture to form the carbonate of any cation beyond that needed to form the salt. A preferred friction modifier is zinc oleate.

4. Extreme Pressure/Anti-Wear Agents

Dialkyl dithiophosphate succinates may be added to provide anti-wear protection. Zinc salts are preferably added as zinc salts of phosphorodithioic acids or dithiocarbamic acid. Among the preferred compounds for use are zinc, diisooctyl dithiophosphate and zinc dibenzyl dithiophosphate and amyl dithiocarbamic acid. Also included in lubricating compositions in the same weight percent range as the zinc salts to give anti-wear/extreme pressure performance are dibutyl hydrogen phosphite (DBPH) and triphenyl monothiophosphate, and the thiocarbamate ester formed by reacting dibutyl amine-carbon disulfide- and the methyl ester of acrylic acid. The thiocarbamate is described in U.S. Pat. No. 4,758,362 and the phosphorus-containing metal salts are described in U.S. Pat. No. 4,466,894. Both patents are incorporated herein by reference. Antimony or lead salts may also be used for extreme pressure. The preferred salts are of dithiocarbamic acid such as antimony diamyldithiocarbamate.

5. Viscosity Modifiers

Viscosity modifiers (VM) and dispersant viscosity modifiers (DVM) are well known. Examples of VMs and DVMs are polymethacrylates, polyacrylates, polyolefins, styrene-maleic ester copolymers, and similar polymeric substances including homopolymers, copolymers and graft copolymers. Examples of commercially available VMs, DVMs and their chemical types are listed below. The DVMs are designated by a (D) after their number. Representative viscosity modifiers that are commercially available are listed below in Table 1.

TABLE 1

| Viscosity Modifier | Tradename | Commercial Source |
|---|---|---|
| 1. Polyisobutylenes | Indopol ® | Amoco |
| | Parapol ® | Exxon (Paramins) |
| | Polybutylene ® | Chevron |
| | Hyvis ® | British Petroleum |
| 2. Olefin copolymers | Lubrizol ® 7060, 7065, 7067 | Lubrizol |
| | Paratone ® 8900, 8940, 8452, 8512 | Exxon |
| | | Exxon (Paramins) |
| | ECA-6911 | Texaco |
| | TLA 347, 555(D), 6723(D) | Uniroyal |
| | Trilene ® CP-40, CP-60 | |

TABLE 1-continued

| Viscosity Modifier | Tradename | Commercial Source |
|---|---|---|
| 3. Hydrogenated styrenediene copolymers | Shellvis ® 50, 40 | Shell |
| | LZ ® 7341, 7351, 7441 | Lubrizol |
| 4. Styrene, maleate copolymers | LZ ® 3702(D), 3715, 3703(D) | Lubrizol |
| 5. Polymethacrylates (PMA) | Acryloid ® 702, 954(D), 985(D), 1019, 1265(D) | Rohm GmbH |
| | TLA 388, 407, 5010(D), 5012(D) | Texaco |
| | Viscoplex ® 4-950(D), 6-500(D), 1515 | Rohm GmbH |
| 6. Olefin-graft PMA polymer | Viscoplex ® 2-500, 2-600 | Rohm GmbH |
| 7. Hydrogenated polyisoprene star polymers | Shellvis ® 200, 260 | Shell |

Summaries of viscosity modifiers can be found in U.S. Pat. Nos. 5,157,088, 5,256,752 and 5,395,539, which are incorporated herein by reference. The VMs and/or DVMs preferably are incorporated into the fully-formulated compositions at a level of up to 10% by weight.

6. Phosphates

The lubricating compositions can also preferably include at least one phosphorus acid, phosphorus acid salt, phosphorus acid ester or derivative thereof including sulfur-containing analogs preferably in the amount of 0.002-1.0 weight percent. The phosphorus acids, salts, esters or derivatives thereof include compounds selected from phosphorus acid esters or salts thereof, phosphites, phosphorus-containing amides, phosphorus-containing carboxylic acids or esters, phosphorus containing ethers and mixtures thereof In one embodiment, the phosphorus acid, ester or derivative can be a phosphorus acid, phosphorus acid ester, phosphorus acid salt, or derivative thereof. The phosphorus acids include the phosphoric, phosphonic, phosphinic, and thiophosphoric acids including dithiophosphoric acid as well as the monothiophosphoric, thiophosphinic and thiophosphonic acids.

One class of compounds are adducts of O,O-dialkyl-phosphorodithioates and esters of maleic or fumaric acid. The compounds can be prepared by known methods as described in U.S. Pat. No. 3,359,203, as for example O,O-di(2-ethylhexyl) S-(1,2-dicarbobutoxyethyl)phosphorodithioate.

Another class of compounds useful to the invention are dithiophosphoric acid esters of carboxylic acid esters. Preferred are alkyl esters having 2 to 8 carbon atoms, as for example 3-[[bis(1-methylethoxy)phosphinothioyl]thio]propionic acid ethyl ester.

A third class of ashless dithiophosphates for use with the present invention include:

(i) those of the formula

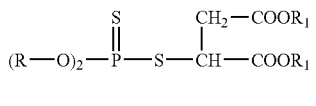

wherein R and $R_1$ are independently selected from alkyl groups having 3 to 8 carbon atoms (commercially available as VANLUBE 7611M, from R. T. Vanderbilt Co., Inc.);

(ii) dithiophosphoric acid esters of carboxylic acid such as those commercially available as IRGALUBE® 63 from Ciba Geigy Corp.;

(iii) triphenylphosphorothionates such as those commercially available as IRGALUBE® TPPT from Ciba Geigy Corp.; and (iv) methylene bis(dialkyldithiocarbamates) wherein the alkyl group contains 4 to 8 carbon atoms. For example, methylenebis(dibutyldithiocarbamate) is commercially available as VANLUBE 7723® from R. T. Vanderbilt Co., Inc).

Zinc salts are preferably added to lubricating compositions in amounts of 0.1-5 triphenylphosphorothionates wherein the phenyl group may be substituted by up to two alkyl groups. An example of this group, among others, is triphenyl-phosphorothionate available commercially as IRGALUBE® TPPT (manufactured by Ciba-Geigy Corp.).

A preferred group of phosphorus compounds are dialkyphosphoric acid mono alkyl primary amine salts, such as those described in U.S. Pat. No. 5,354,484 which is herein incorporated by reference. Eighty-five percent phosphoric acid is the preferred compound for addition to the fully formulated ATF package and is preferably included at a level of about 0.01-0.3 weight percent based on the weight of the ATF.

The amine salts of alkyl phosphates are prepared by known methods, e.g., a method disclosed in U.S. Pat. No. 4,130,494, incorporated herein by reference. A suitable mono- or diester of phosphoric acid or their mixtures is neutralized with an amine. When mono-ester is used, two moles of the amine will be required, while the diester will require one mole of the amine. In any case, the amount of amine required can be controlled by monitoring the neutral point of the reaction where the total acid number is essentially equal to the total base number. Alternately, a neutralizing agent such as ammonia or ethylenediamine can be added to the reaction.

The preferred phosphate esters are aliphatic esters, among others, 2-ethylhexyl, n-octyl, and hexyl mono- or diesters. The amines can be selected from primary or secondary amines. Particularly preferred are tert-alkyl amines having 10 to 24 carbon atoms. These amines are commercially available as for example Primene® 81R manufactured by Rohm and Haas Co.

The sulfonic acid salts are well known in the art and are available commercially. Representative of the aromatic sulfonic acids that can be used in preparing the synergists of the invention are alkylated benzenesulfonic acids and alkylated naphthalenesulfonic acids having 1 to 4 alkyl groups of 8 to 20 carbons each. Particularly preferred are naphthalenesulfonates substituted by alkyl groups having 9 to 18 carbons each, as for example dinonylnaphthalenesulfonate.

7. Antifoamants

Antifoaming agents are well-known in the art as silicone or fluorosilicone compositions. Such antifoam agents are available from Dow Corning Chemical Corporation and Union Carbide Corporation. A preferred fluorosilicone antifoam product is Dow FS-1265. Preferred silicone antifoam products are Dow Corning DC-200 and Union Carbide UC-L45. Other antifoam agents which may be included in the composition either alone or in admixture is a polyacrylate antifoamer available from Monsanto Polymer Products Co. of Nitro, W. Va. known as PC-1244. Also, a siloxane polyether copolymer antifoamer available from OSI Specialties, Inc. of Farmington Hills, Mich. and may also be included. One such material is sold as SILWET-L-7220. The antifoam products are preferably included in the compositions of this invention at a level of 5 to 80 parts per million with the active ingredient being on an oil-free basis.

8. Rust Inhibitors

Embodiments of rust inhibitors include metal salts of alkylnaphthalenesulfonic acids.

9. Copper Corrosion Inhibitors

Embodiments of copper corrosion inhibitors which may optionally be added include include thiazoles, triazoles and thiadiazoles. Example embodiments of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-bis(hydrocarbyldithio)-1,3,4-thiadiazoles.

EXAMPLES

With reference to Tables 1 and 2 below, a 4-ball wear test was conducted with respect to a polyolester base oil alone (test 1), a comparative test 2 based on the existing bearing lubricant based on TCP (tricresyl phosphate), a well-known anti-wear additive typically used in gas turbine oil compositions), and inventive tests based on thiadiazole dimer derivate (Vanlube® 972 additive) alone and additionally containing molybdenum dithiocarbamate or molybdenum dithiophosphate. The base oil used was Hatco® HXL-7597, which is a polyolester with antioxidant and corrosion inhibitors, available from Hatco Corporation. The molybdenum dithiocarbamate tested was Molyvan® 822 additive, available from R.T. Vanderbilt Company, Inc. (molybdenum dialklyldithiocarbamate 50% in petroleum process oil 50%). The molybdenum dithiophosphate tested was Molyvan® L additive, available from R.T. Vanderbilt Company, Inc. (molybdenum di(2-ethylhexyl)phosphorodithioate 75% in petroleum process oil 25%).

It is clear from the results in the Tables below that thiadiazole dimer derivative provides surprisingly superior anti-wear protection in the base oil, compared to the standard TCP formulation; and that the further addition of metal dithiocarbamate or metal dithiophosphate increases the anti-wear protection still further. It is noted that 2,5-dimercapto-1,3,4 thiadiazole (DMTD) monomer derivatives were tested, but did not provide adequate anti-wear protection (wear scars above 2 mm). Therefore, it is surprising that DMTD monomer itself, un-derivatized, does provide good anti-wear protection.

TABLE 1

| | Mass Percent | | | | | | | | |
|---|---|---|---|---|---|---|---|---|---|
| | 1 | 2 | 3a | 3b | 3c | 3d | 3e | 4 | 5 |
| Hatco Ref Oil* | 100 | 98 | 99.75 | 99.5 | 99.0 | 98.0 | 97.0 | 99.0 | 99.0 |
| TCP | — | 2 | — | — | — | — | — | — | — |
| VANLUBE ® 972 | — | — | 0.25 | 0.5 | 1.0 | 2.0 | 3.0 | 0.5 | 0.5 |
| MOLYVAN ® 822 | — | — | — | — | — | — | — | 0.5 | — |

TABLE 1-continued

| | Mass Percent | | | | | | | | |
|---|---|---|---|---|---|---|---|---|---|
| | 1 | 2 | 3a | 3b | 3c | 3d | 3e | 4 | 5 |
| (MoDTC content) | | | | | | | | (0.25) | |
| MOLYVAN ® L | — | — | — | — | — | — | — | — | 0.5 |
| (MoDTP content) | | | | | | | | | (0.375) |
| 4-Ball Wear | | | | | | | | | |
| 1200 rpm, 75° C., 1 h | | | | | | | | | |
| 440-C steel balls, mm | 2.68 | 3.07 | 2.13 | 0.72 | 0.84 | 1.02 | 1.14 | 0.59 | 0.35 |
| | — | — | | 0.72 | | | | 0.55 | 0.50 |
| | — | — | | — | | | | 0.62 | 0.44 |
| | — | — | | — | | | | 0.63 | — |
| Average | — | — | | 0.72 | | | | 0.60 | 0.43 |

*97.95% HXL-7597 base oil with antioxidant and corrosion inhibitors: 1.0% Vanlube ® 81 additive (mixture of octylated diphenylamines), 1.0% alkylated PANA (Ciba ® L-06) and 0.05% benzotriazole.

In Table 2 below, other well-known anti-wear additives were tested and also displayed poor performance when used to protect corrosion resistant steel. These additives includes zinc dithiophosphates (ZDDP), amine phosphates (Vanlube® 672, 692, and 9123 additives), ashless dithiophosphates (Vanlube® 727 and 7611M additives), borate esters (OD/Vanlube® 289 additive), and tert-butylated phenol phosphates (Durad® 620B additive).

TABLE 2

| | | Base: Hatco HXL-7597 w/Antioxidants + Corrosion Inhibitor 4-Ball Wear 1200 rpm, 1 h; @ 40 kgf | |
|---|---|---|---|
| | Formulation | 440-C Steel | Standard Steel |
| 1) | Base oil | 2.68 | 0.69 |
| 2) | +2.0% TCP | 3.07 | 0.43 |
| 3) | +2.0% VANLUBE ® 972 | 1.04, 1.02 | 1.13 |
| 4) | +3.0% VANLUBE ® 972 | 1.14 | — |
| 5) | +1.0% VANLUBE ® 972 | 0.84, 0.84 | — |
| 6) | +0.5% VANLUBE ® 972 | 0.72, 0.71, 0.73 | — |
| 7) | +0.25% VANLUBE ® 972 | 2.13 | — |
| 8) | +1.00% MOLYVAN ® 822 | 3.13 | — |
| 9) | +2.00% MOLYVAN ® L | 2.80 | — |
| 10) | +0.5% VANLUBE ® 972 +0.5% MOLYVAN ® 822 | 0.59, 0.55, 0.62, 0.50 | 0.64 |
| 11) | +0.5% VANLUBE ® 972 +0.5% MOLYVAN ® L | 0.35, 0.50, 0.44 | 0.61 |
| 12) | +2.0% MOLYVAN ® 855 | Not Run | — |
| 13) | +2.0% OCD-289 | 3.11 | — |
| 14) | +2.0% VANLUBE ® 7723 | 2.10 | 0.56 |
| 15) | +2.0% W-DTC | 2.85 | — |
| 16) | +2.0% VANLUBE ® 727 | 2.53 | — |
| 17) | +2.0% VANLUBE ® 7611 M | 2.87 | — |
| 18) | +2.0% VANLUBE ® 871 | 2.05 | — |
| 19) | +0.5% VANLUBE ® 871 | 2.10 | — |
| 20) | +2.0% CUVAN ® 826 | 2.07 | — |
| 21) | +4.0% VANLUBE ® AZ | 2.35 | — |
| 22) | +2.0% VANLUBE ® 692 | 2.50 | — |
| 23) | +2.0% VANLUBE ® 672 | 2.68 | — |
| 24) | +2.0% VANLUBE ® 9123 | 2.43 | — |
| 25) | +2.0% ZDDP | 2.53 | — |
| 26) | +0.5% VANLUBE ® 972 +0.5% ZDDP | 0.75 | — |
| 27) | +2.0% Durad ® 620B | 2.90 | — |
| 28) | +2.0% LDP ® 375 | 2.73 | — |
| 29) | +0.5% VANLUBE ® 972 +0.5% Durad ® 620B | 1.88 | — |
| 30) | +0.5% VANLUBE ® 972 +0.5% LDP ® 375 | 0.72 | — |
| 31) | +2.0% OD-0202 | 2.78 | — |
| 32) | +2.0% BOTG | 2.68, 2.73 | — |

TABLE 2-continued

| | | Base: Hatco HXL-7597 w/Antioxidants + Corrosion Inhibitor 4-Ball Wear 1200 rpm, 1 h; @ 40 kgf | |
|---|---|---|---|
| | Formulation | 440-C Steel | Standard Steel |
| 33) | +0.2% VANLUBE ® 829 | 0.75, 0.73 | — |
| 33) | +0.2% VANLUBE ® 829 | 0.70 | — |
| 34) | +0.5% VANLUBE ® 829 +0.5% MOLYVAN ® L | 0.40 | — |
| 34) | +0.5% VANLUBE ® 829 +0.5% MOLYVAN ® L | 0.39 | — |
| 35) | +0.1% VANLUBE ® 829 | 0.72 | — |
| 36) | +0.05% VANLUBE ® 829 | 2.20 | — |
| 37) | +0.1% VANLUBE ® 829 +0.5% MOLYVAN ® L | 0.35 | — |
| 38) | +0.1% VANCHEM ® DMTD | 0.79 | — |
| 39) | +0.1% VANCHEM ® DMTD +0.5% MOLYVAN ® L | 0.46 | — |

TCP - tricresyl phosphate
Vanlube ® 972 - (1,3,4-thiadiazole derivative 40% and triethylene glycol monobutyl ether 60%)
Vanlube ® 829 - (1,3,4-thiadiazole-2(3H)-thione,5,5-dithiobis)
Molyvan ® 822 - (molybdenum diallylthiocarbamate 50% in petroleum process oil 50%)
Molyvan ® L - (molybdenum di(2-ethylhexyl)phosphorodithioate 75% in petroleum process oil 25%)
Vanlube ® 871 - (2,5-dimercapto-1,3,4-thiadiazole, alkyl carboxylates)
Cuvan ® 826 - (2,5-bis(n-octyldithio)-1,3,4-thiadiazole 60-80%; dioctyl disulfide 20-40%)
Vanchem ® DMTD - (2,5-dimercapto-1,3,4-thiadiazole)
Vanchem ® DMTD - (2,5-dimercapto-1,3,4-thiadiazole)
Vanlube ® 7723 - methylenebis(dithiodicarbamate)
W-DTC - Tungsten dithiocarbamate
Vanlube ® AZ - Zinc diamyldithiodicarbamate in oil
LDP ® 375 - aromatic oligomeric phosphate
OD-0202 - tris[2(or 4)-C9-C10-branched alkylphenyl]phosphorothionate
BOTG - butoxytriglycol The success of a thiadiazole dimer derivative, such as Vanlube® 972 additive, as an anti-wear additive for polyol ester oils is quite surprising. In particular, this is because this additive was developed for a completely different purpose, namely as an extreme pressure additive for greases. While there is a degree of haziness when used with a polyolester, the solubility is complete (i.e. the product is clear) when the MoDTC or MoDTP is also added.

From the above, it can be seen that an amount of thiadiazole dimer derivative provides optimal anti-wear performance at about 0.5% by weight, based on the total lubricant composition, in combination with a polyolester base oil. Good results are also obtained at amounts up to about 3.0%. It is expected that about 0.5% to about 5.0% Vanlube® 972 thiadiazole dimer derivative should also give good results. Even better results, in terms of solubility and anti-wear performance, are achieved when the Vanlube® 972 thiadiazole dimer derivative additive is accompanied by an amount of molybdenum dithiocarbamate (MoDTC) or molybdenum dithiophosphate (MoDTP). In particular, excellent results are shown for a combination of 0.5% thiadiazole dimer derivative (Vanlube® 972) and 0.25% molybdenum dithiocarbamate (as 0.5% Molyvan® 822, MoDTC diluted 50% in process oil) and with 0.375% molybdenum dithiophosphate (as 0.5% Molyvan® L). It is expected that effective additive amounts in combination with thiadiazole dimer derivates, such as Vanlube® 972, will be in a range of about 0.1% to about 2.5% by weight metal DTC and/or about 0.1 to about 3.0%, by weight metal DTP, preferably wherein the metal is molybdenum, and in each case based on the total weight of the composition.

Vanlube® 829 additive is a DMTD dimer derivative. Excellent anti-wear results are shown for this additive from about 0.1% to about 0.5% by weight based on the total weight of the composition, with expected good results up to about 5.0% by weight. Addition of a metal DTP or DTC is provides even further increase in performance, with data shown for the combination with MoDTP (Molyvan® L) (compare Formulation 34 in Table 2 with Formulations 33 and 36).

Vanchem® DMTD (monomer) is also shown to give excellent results, which results are further improved with the addition of MoDTP. It is expected that other metal DTCs and DTPs will also improve the anti-wear performance. While U.S. Pat. No. 5,422,023 suggests that a copolymer corrosion inhibitor should be used in combination with a DMTD monomer, the present invention provides for a lubricating anti-wear composition for use with corrosion-resistant materials (such as jet turbines manufactured of same) comprising a synthetic base oil and DMTD monomer, without the need for (i.e. being free of) a corrosion inhibitor such as that required by '023 patent.

Other embodiments of the invention will be apparent to the skilled in the art from a consideration of this specification or practice of the invention disclosed herein. It is intended that the specification and examples be considered as exemplary only, with the scope and spirit of the invention being indicated by the following claims.

Figure 2:
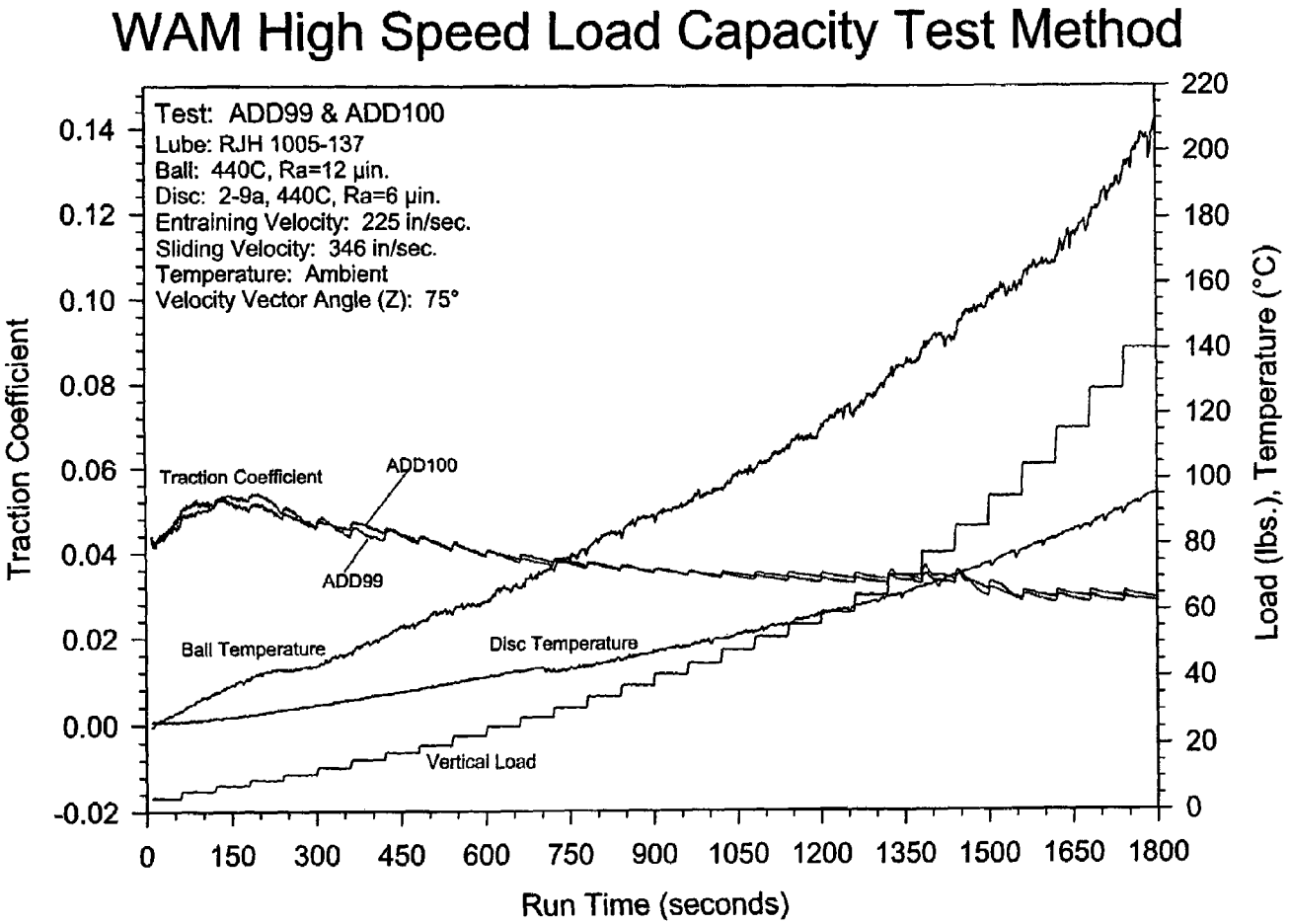
FIG. 2 is a graphical representation of the traction coefficient versus WAM Run Time plots for inventive Example 5, labeled as 1005-137 in this figure.
Figure 3:
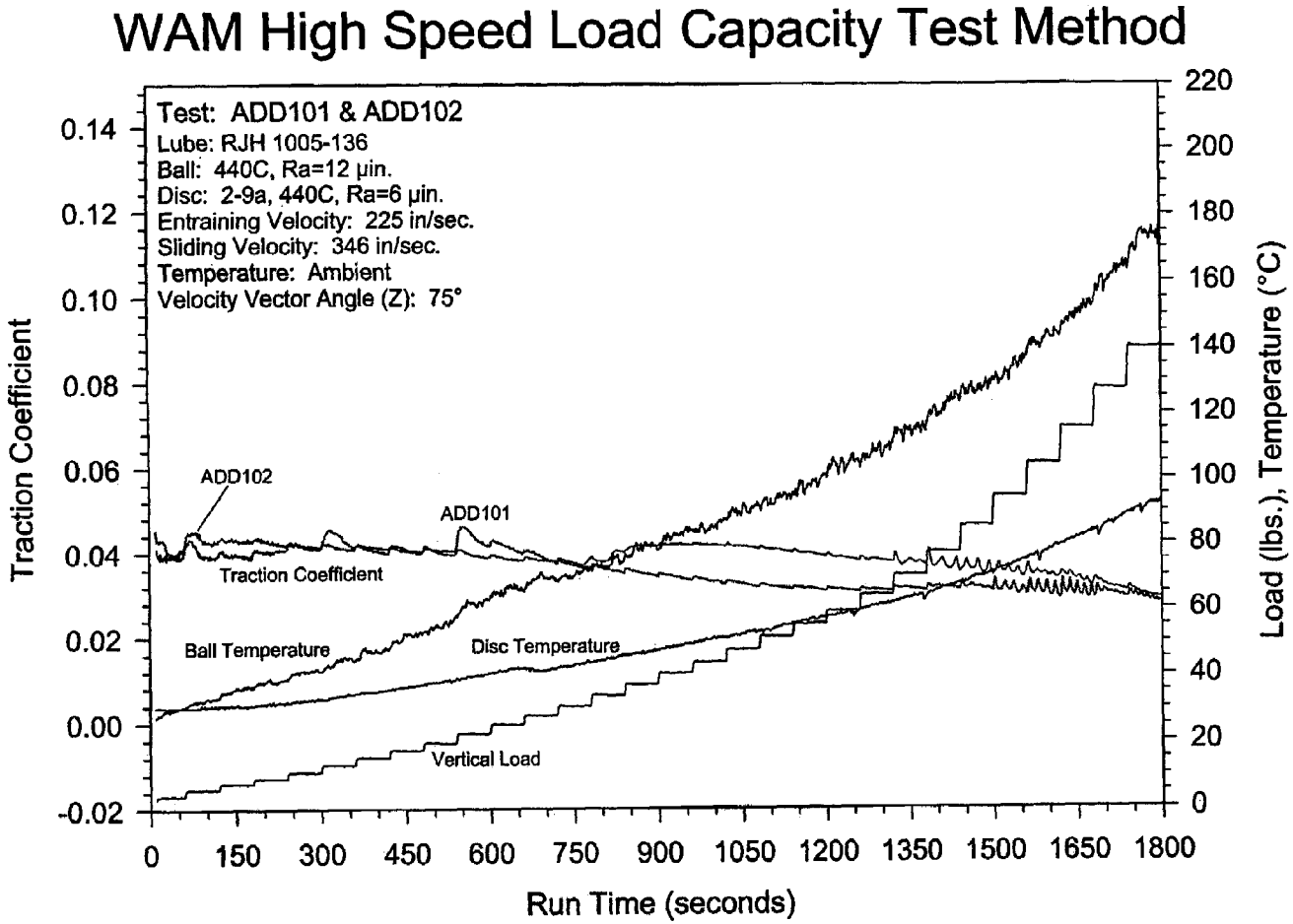
FIG. 3 is a graphical representation of the traction coefficient versus WAM Run Time plots for inventive Example 4, labeled as 1005-136 in this figure.
Figure 4:
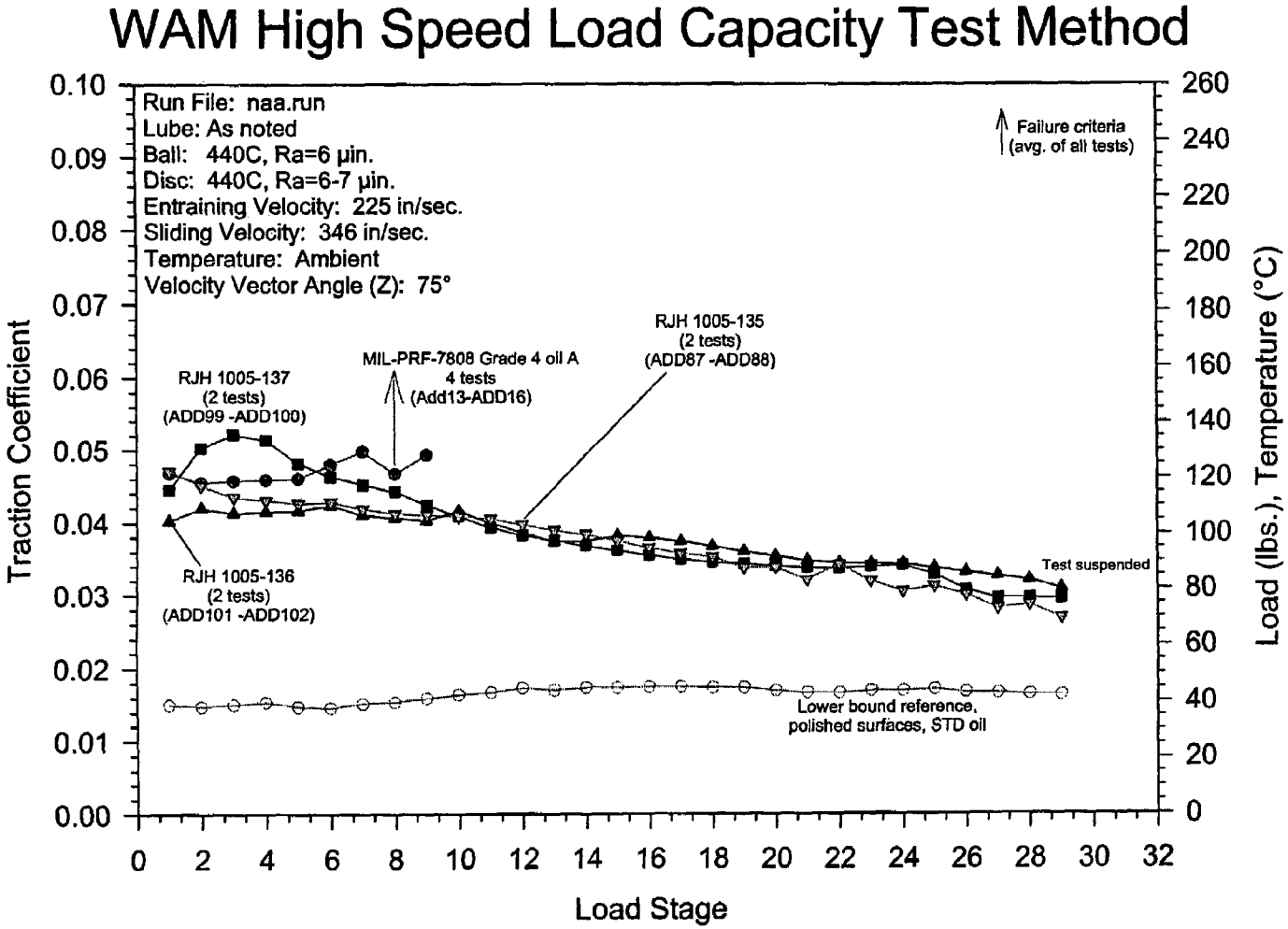
FIG. 4 is a graphical representation of the traction coefficient versus WAM Run Time plots for Examples 3b, 4 and 5 labeled as and 1005-135, 1005-136 and 1005-137 respectively in this figure.
Figure 5:
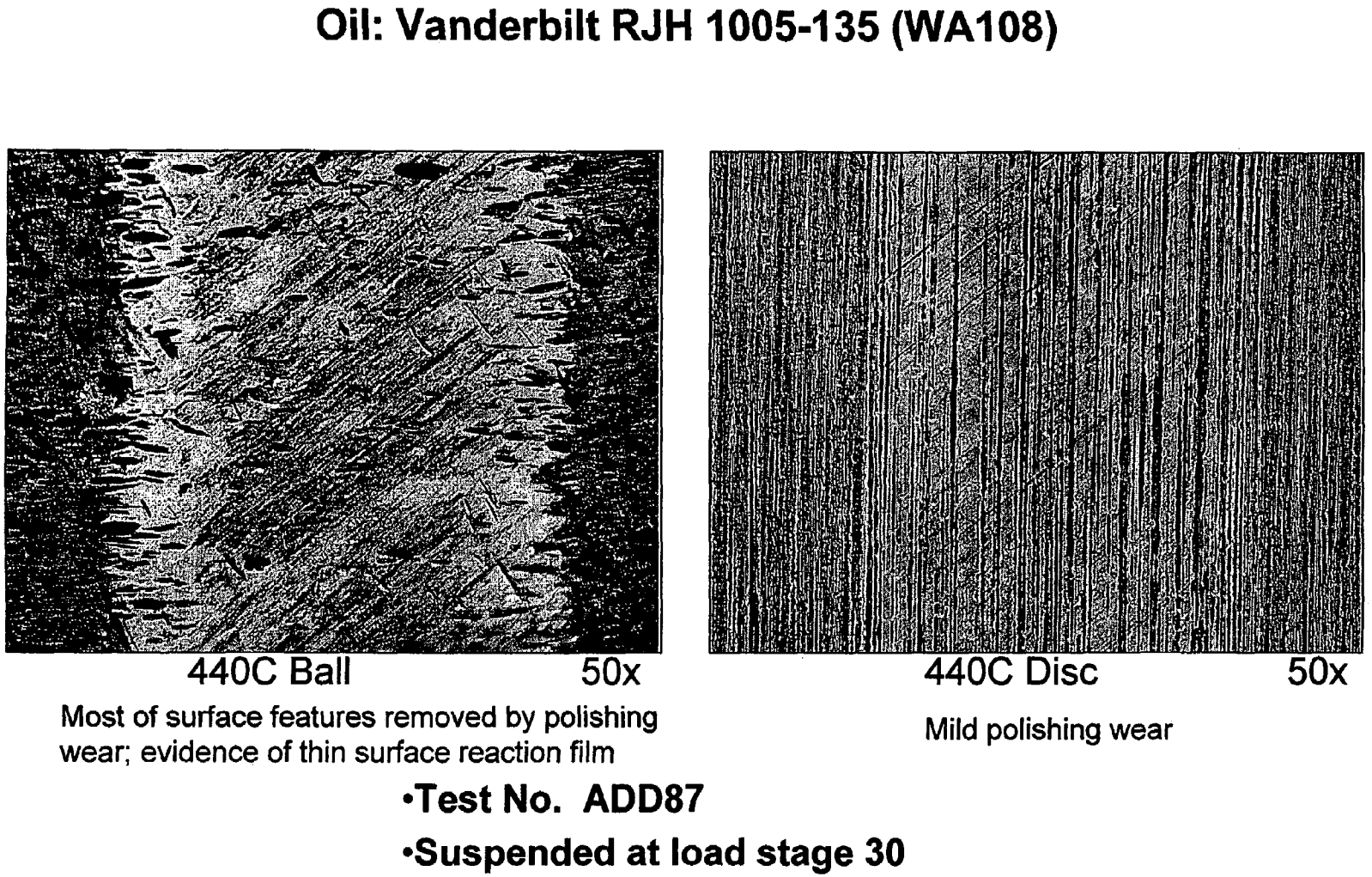
FIG. 5 shows photomicrographs of ball and disc after 30 stages WAM test for Example 3b also known as WA 108 and 1005-135. Polishing wear is evident with only thin surface film.
Figure 6:
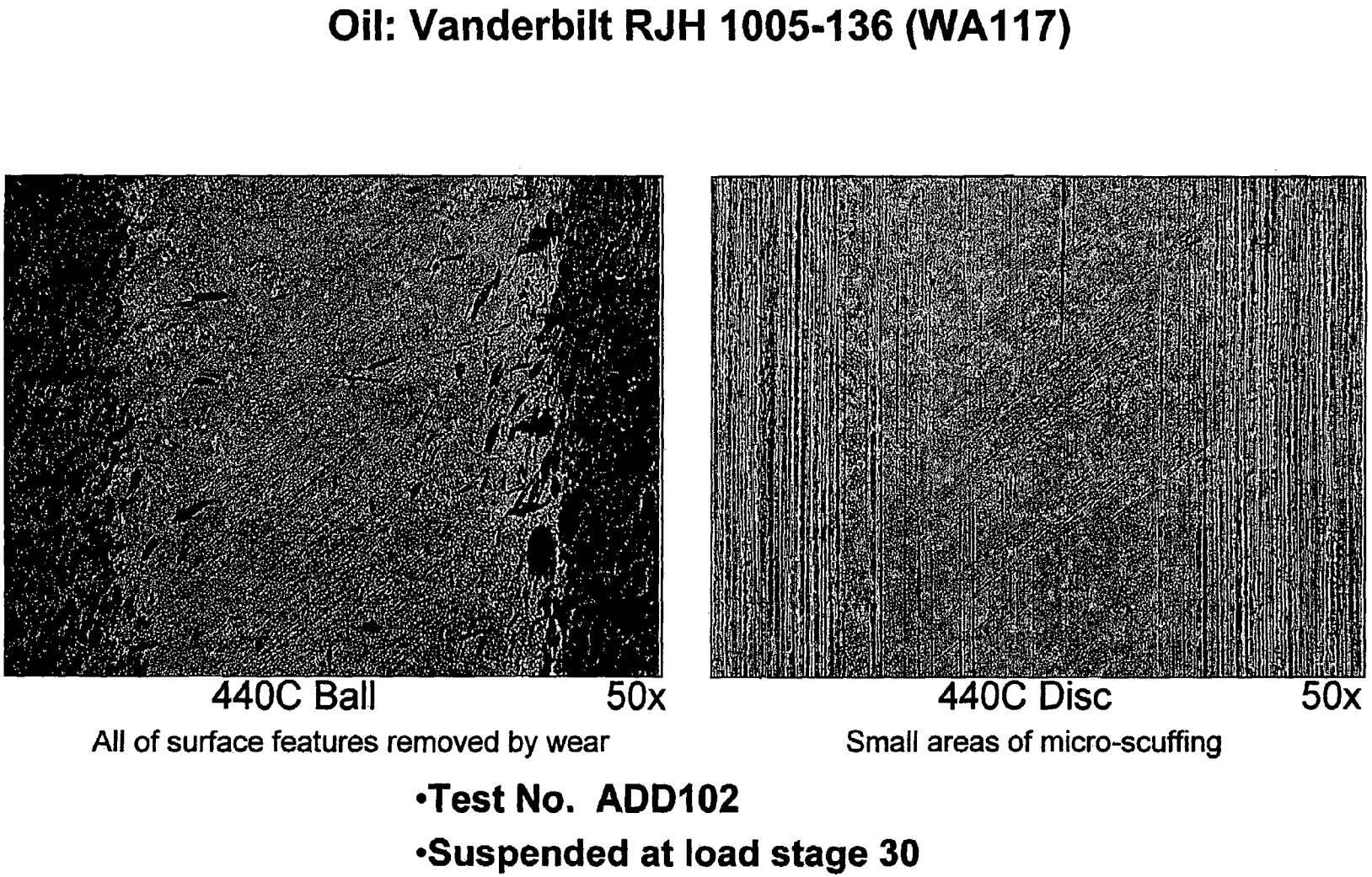
FIG. 6 shows photomicrographs of ball and disc after 30 stages WAM test for inventive Example 4, also known as WA 117 and 1005-136. Polishing wear and micro-scuffing is evident.
Figure 7:
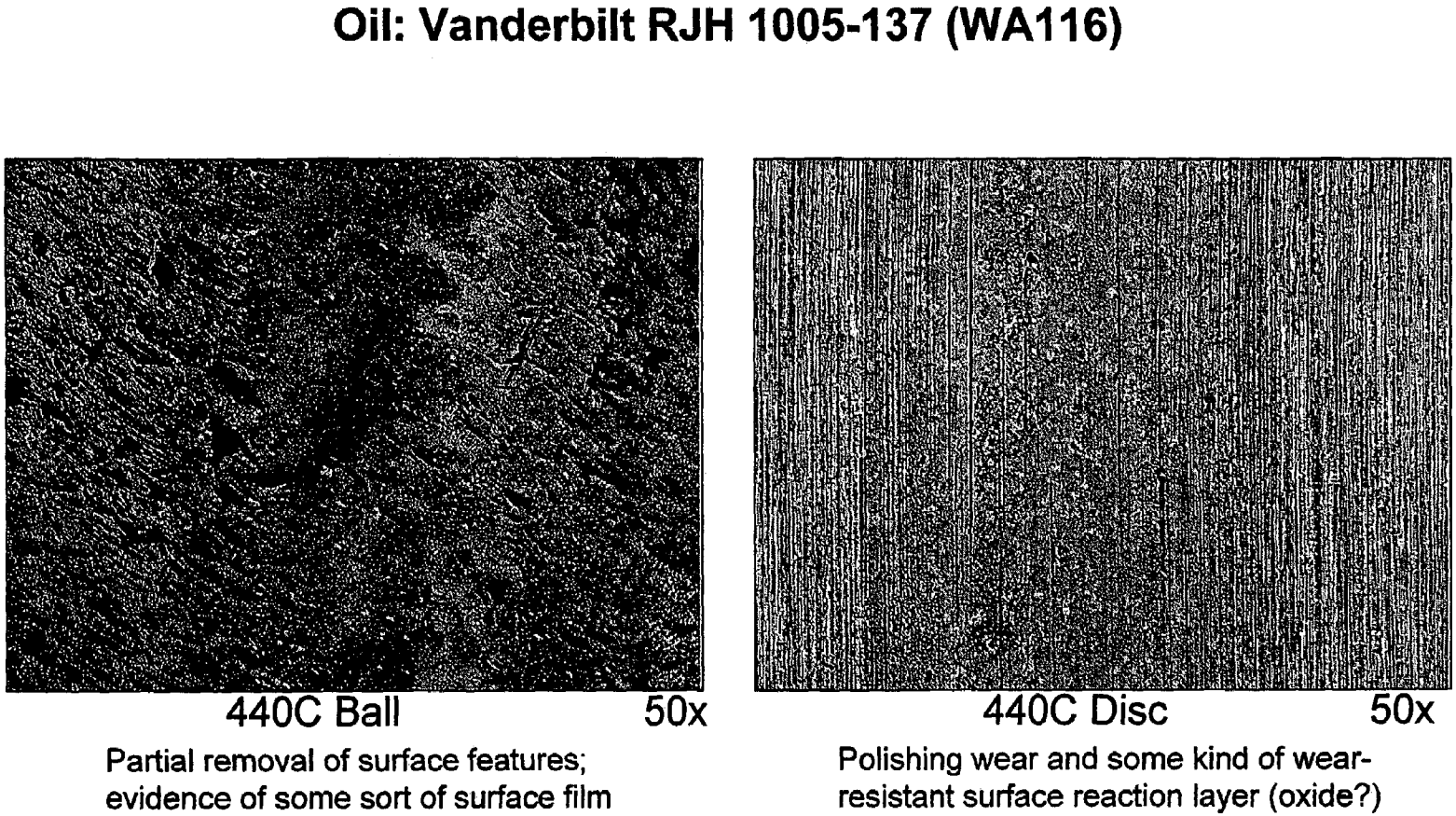
FIG. 7 shows photomicrographs of ball and disc after 30 stages WAM test for inventive Example 5, also known as WA 116 and 1005-137. Some polishing wear topped with wear resistant surface film is evident.

In addition to the antiwear data relative to the 4-ball wear test, the inventive compositions are also shown to have excellent results with respect to traction coefficient (WAM High Speed Load Capacity Test). FIG. 1 shows a graph of traction coefficient for a wide variety of additive candidates, with the inventive compound of Test 3 above (WA 108 in the figure) having exceptionally good characteristics. Generally, formulations that form wear protective coatings on roughness features result in higher traction. As roughness features polish down, traction coefficient decreases. Most of the formulations in FIG. 1 have marginal wear resistance and in most cases poor scuffing performance. The low traction formulation WA 108 would be less prone toward surface-initiated fatigue than high traction oils, which limit polishing wear of roughness and cause higher asperity stress. FIGS. 2-4 show further individualized testing of traction coefficient for reference formulations 1005-135, 1005-136 and 1005-137, corresponding to inventive formulation tests 3b, 4 and 5, respectively. All formulations reached test suspension at load stage 30 without a scuffing event, and exhibited low traction coefficient. Remarkably, these formulations also exhibit excellent antiwear properties, which is unusual in conjunction with low traction coefficient. FIGS. 5-7 are photomicrographs showing surfaces after test runs using the inventive lubricant formulations.

The invention claimed is:

1. A method for imparting anti-wear properties to a high chrome alloy steel, comprising using an effective amount of a lubricating composition on a high chrome alloy steel surface, the lubricating composition comprising a major amount of a grease or synthetic ester base oil and a minor amount of:

(a) a molybdenum compound selected from the group consisting of molybdenum dithiocarbamate, molybdenum dithiophosphate and a mixture thereof; and (b) one or more anti-wear compound(s) selected from the group consisting of:

(i) a reaction product of:

(A) a thiadiazole dimer having formula (I):

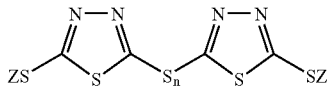

(I)

where Z is hydrogen, or an alkyloxy linkage having formula (II):

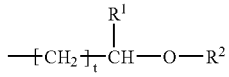

(II)

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, with n being 1 to 2 and t being 0 or 1; and (B) a poly(ether)glycol having formula (III):

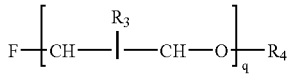

(III)

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300;

(ii) a reaction product of:

(A) a thiadiazole dimer having formula (VI):

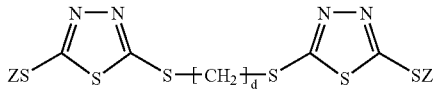

(VI)

where d is 1 to 5 and Z is hydrogen, an alkyloxy linkage having formula (II):

(II)

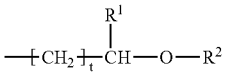

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, wherein t is 0 or 1; and (B) a poly(ether)glycol having formula (III):

(III)

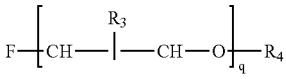

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300; and (iii) a mono or dimercapto-1,3,4-thiadiazole monomer which has the structure of formula (VII):

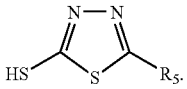

Where R5 is mercaptan, —SH or hydrogen, —H, wherein the weight ratio of the molybdenum compound (a) to the anti-wear compound/compounds (b) is about 1:10 to about 10:1.

2. The method of claim 1, wherein the weight ratio of the molybdenum compound to the anti-wear compound is about 1:4 to about 4:1.

3. The method of claim 2, wherein the weight ratio of the molybdenum compound to the anti-wear compound is about 1:2 to about 1:1.

4. The method of claim 1, wherein the anti-wear compound is (i).

5. The method of claim 4, wherein the reaction product comprises of one or both of a compound of formula (IV):

(IV)

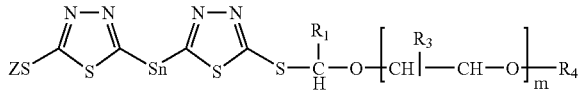

or a compound of formula (V)

(V)

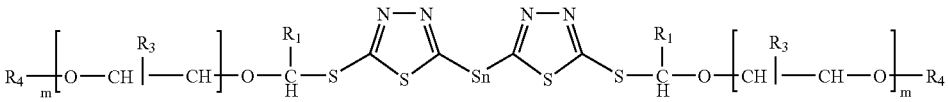

wherein in is 1 to 50.

6. The method of claim 1, wherein the anti-wear compound is (ii).

7. The method of claim 1, wherein the anti-wear compound is (iii).

8. The method of claim 1, wherein the molybdenum compound is molybdenum dithiocarbamate.

9. The method of claim 8, wherein the molybdenum dithiocarbamate is molybdenum dialkylthiocarbamate.

10. The method of claim 1, wherein the molybdenum compound is molybdenum dithiophosphate.

11. The method of claim 2, wherein the molybdenum dithiophosphate is molybdenum di(2ethylhexyl)phosphorodithioate.

12. The method according to claim 1, wherein the steel is 440C stainless steel.

13. In combination, a high chrome alloy and a lubricating composition comprised of a major amount of a grease or synthetic ester base oil and a minor amount of:

(a) a molybdenum compound selected from the group consisting of molybdenum dithiocarbamate, molybdenum dithiophosphate and a mixture thereof; and (b) one or more anti-wear compound(s) selected from the group consisting of:

(i) a reaction product of:

(A) a thiadiazole dimer having formula (I):

(I)

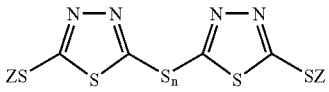

where Z is hydrogen, or an alkyloxy linkage having formula (II):

(II)

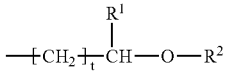

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, with it being 1 to 2 and being 0 or 1; and (B) a poly(ether)glycol having formula (III):

(III)

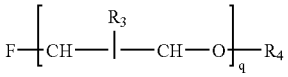

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300;

(ii) a reaction product of:

(A) a thiadiazole dimer having formula (VI):

(VI)

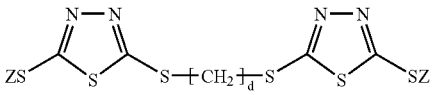

where d is 1 to 5 and Z is hydrogen, an alkyloxy linkage having formula (II):

(II)

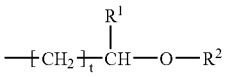

or combinations thereof, with $R^1$ being hydrogen, a branched or straight chain $C_1$ to $C_7$ alkyl radical, or combinations thereof and $R^2$ being hydrogen, a branched or straight chain $C_1$ to $C_7$ alkyl radical, or combinations thereof, wherein t is 0 or 1; and (B) a poly(ether)glycol having formula (III):

(III)

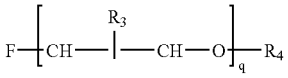

where F is a hydroxyl radical, a branched or straight chain $C_1$ to $C_{20}$ alkoxyl radical, a branched or straight chain $C_1$ to $C_{20}$ alkylcarboxyl radical, a mono-substituted, disubstituted, or tri-substituted glycerol residue, hydrogen, or combinations thereof; where $R^3$ is hydrogen, a methyl radical, or combinations thereof; where $R^4$ is hydrogen, a branched or straight chain $C_1$ to $C_{20}$ alkyl radical, a phenyl radical, a $C_1$ to $C_8$ branched or straight chain alkyl-substituted-phenyl radical, a $C_1$ to $C_{20}$ branched or straight chain acyl radical, or combinations thereof; and with q being 1 to 300; and (iii) a mono or dimercapto-1,3,4-thiadiazole monomer which has the structure of formula (VII):

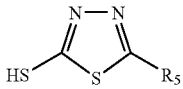

Where R5 is mercaptan —SH or hydrogen, —H, wherein the weight ratio of the molybdenum compound (a) to the anti-wear compound/compounds (b) is about 1:10 to about 10:1.

14. The combination of claim 13, wherein the weight ratio of the molybdenum compound to the anti-wear compound is about 1:4 to about 4:1.

15. The combination of claim 14, wherein the weight ratio of the molybdenum compound to the anti-wear compound is about 1:2 to about 1:1.

16. The combination of claim 13, wherein the anti-wear compound is (i).

17. The combination of claim 16, wherein the reaction product comprises of one or both of a compound of formula (IV):

(IV)

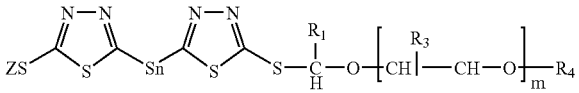

or a compound of formula (V)

(V)

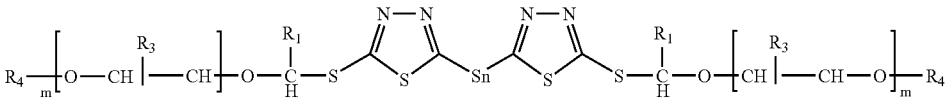

wherein m is 1 to 50.

18. The combination of claim 13, wherein the anti-wear compound is (ii).

19. The combination of claim 13, wherein the anti-wear compound is (iii).

20. The combination of claim 13, wherein the molybdenum compound is molybdenum dithiocarbamate.

21. The combination of claim 20, wherein the molybdenum dithiocarbamate is molybdenum dialkylthiocarbamate.

22. The combination of claim 13, wherein the molybdenum compound is molybdenum dithiophosphate.

23. The combination of claim 14, wherein the molybdenum dithiophosphate is molybdenum di(2-ethylhexyl)phosphorodithioate.

* * * * *